United States Patent [19]

Tanikawa et al.

[11] 4,104,419

[45] Aug. 1, 1978

[54] SURFACE TREATMENT OF A TIN-PLATE

[75] Inventors: Keiichi Tanikawa, Yokohama; Tatsuro Obi, Tokyo; Tadashi Tanaka; Susumu Otsuka, both of Yokohama; Takao Saito, Himeji, all of Japan

[73] Assignee: Nippon Steel Corporation, Tokyo, Japan

[21] Appl. No.: 718,318

[22] Filed: Aug. 27, 1976

[30] Foreign Application Priority Data

Aug. 27, 1975 [JP] Japan ..... 50-103677

[51] Int. Cl.[2] ..... B05D 3/02; B05D 3/14

[52] U.S. Cl. ..... 427/46; 204/37 T; 427/49; 427/376 D; 427/376 E; 427/376 H; 427/384; 427/405; 427/419 A; 427/419 D

[58] Field of Search ..... 204/37 T; 427/405, 419 A, 427/419 D, 383 C, 372 B, 49, 46, 376 H, 376 E, 376 D, 384

[56] References Cited

U.S. PATENT DOCUMENTS

| | | | |
|---|---|---|---|
| 2,876,176 | 3/1959 | Pearson et al. | 204/37 T |
| 3,535,166 | 10/1970 | Hamilton | 148/6.2 |
| 3,585,051 | 6/1971 | Johnson | 148/6.14 R |
| 3,891,470 | 6/1975 | Kotone et al. | 148/6.14 R |
| 3,915,812 | 10/1975 | Yamagishi et al. | 204/37 T |
| 3,966,502 | 6/1976 | Binns | 148/6.14 R |
| 3,973,998 | 8/1976 | Dotta et al. | 148/6.14 R |

*Primary Examiner*—Harry J. Gwinnell
*Attorney, Agent, or Firm*—Wenderoth, Lind & Ponack

[57] ABSTRACT

A method for surface treatment of an electrolytic tin plate, comprising treating a tin-plated steel sheet with an aqueous solution containing at least one selected from the group consisting of pyrazole derivatives and colloidal substances, drying and reflowing the tin-plated steel sheet.

8 Claims, No Drawings

SURFACE TREATMENT OF A TIN-PLATE

FIELD OF THE INVENTION

The present invention relates to surface treatment of a tin plate.

Generally, the tin plate is produced by tin-plating a low-carbon cold rolled steel sheet in a tin-plating bath through cathodic electrolysis. In order to give a desired surface luster to the tin coating, reflowing is performed by means of resistance melting with current directly applied thereto or high-frequency induction melting and then an electrolytic treatment in an aqueous solution containing hexavalent chromium.

Most of the electrolytic tin plates have been widely used as various food cans. Usually, as for the cans for fruits, asparagus and milk, the tin plate is directly made into cans while in case of food cans for carbonate beverage, beer, fish and meat, the whole inside surfaces of these cans are coated with paint in order to prevent dissolution of tin from the tin plate. Among many various foods, foods containing sulfide, such as fish, meat and asparagus when contained in the food cans cause often discoloration on the inside of the cans due to their sulfide content. Apart from these phenomena, the surface treatment by electrolysis in a chromic acid solution tends to cause poor adhesion of the paint coating, which in turn causes peel-off of the paint coating, thus lowering the commercial value of the cans.

SUMMARY OF THE INVENTION

The present invention is to provide an electrolytic tin plate free from discoloration (yellow stain) and having improved soldering property, paint adhesion, smudge property, eye-hole property, corrosion resistance against sulfide and other properties.

According to the present invention, immediately after a cold rolled steel sheet is tin-plated, but prior to the reflowing step of the tin coating, the tin-plated steel sheet is subjected to a treatment in an aqueous solution containing 0.1 to 10% preferably 0.1 to 3% of a pyrazole derivative having a general formula shown below, or an aqueous solution containing 0.1 to 10% of substance, such as silica sol, and alumina sol, or an aqueous solution containing 0.1 to 10% preferably 0.1 to 3% of a pyrazole compound and 0.1 to 10% of a colloidal substance.

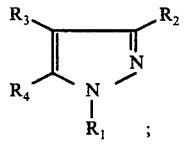

wherein $R_1$ represents H—$CH_2OH$ or —$CH_2COOH$, $R_2$ and $R_4$ represent respectively an alkyl group of $C_1$ to $C_{10}$, —OH or —$CH_2OH$, and $R_3$ represents H, —$NH_2$ and other functional groups. Then the reflowing of the tin coating layer is performed by resistant heating or high frequency induction heating. If necessary, the above chemical treatment may be done again after the reflowing.

According to the conventional chemical treatment of tin plates, the treatment is done by cathodic electrolysis in a chromic acid solution and the surface conditions obtained by this treatment depend on treating conditions such as the concentration of the sodium bichromate, the temperatures and the electrolizing conditions.

The treatment according to the present invention may be done by simple immersion in the treating solution or simple spraying of the solution and then by squeezing with rubber rolls, etc. to obtain a uniform treatment.

It should be noted that after the reflowing step following the chemical treatment according to the present invention, a conventional chromate treatment may be done.

In particular, the present invention produces excellent coating adhesion as well as excellent resistance against sulfide.

DETAILED DESCRIPTION OF THE PRESENT INVENTION

The pyrazole derivative of the general formula (a) used in the present invention has a very low toxity. For example, 3-methyl-5-hydroxpyrazole used in the present invention shows a toxity of $LD_{50}$ value of 10 g/kg by oral administration in the toxity test on rats, and a TLm value of 3000 ppm on the toxity test on killfish, and this has been proved to be a safe substance in view of its toxity. As for the concentration of the pyrazole derivatives, the most preferable range is 0.1 to 3%, but it may be contained upto about 10% depending on the treating condition. However a high concentration of the pyrazole derivative exerts adverse effects on the paint adhesion.

The present invention will be more clearly understood from the following examples, but it should be noted that the present invention is not limited to the examples.

EXAMPLE 1

A cold rolled steel sheet of 0.3 mm thickness for tin-plating is decreased, acid-pickled and electrolyzed in an acidic tin-plating solution to obtain a tin plate with #50 (0.5 lb/BB or 5g/m$^2$) tin coating. The tin plate thus obtained is sprayed with an aqueous solution of 1% 3-methyl-5-hydroxypyrazole at room temperature, squeezed uniformly by means of rubber rolls, dried with air blowing, and immediately subjected to reflowing by means of resistance melting with current directly applied thereto.

EXAMPLE 2

A tin plate with #50 tin coating obtained in a similar way as in Example 1 is immersed in an aqueous solution of 2% alumina sol at ordinary temperature, uniformly squeezed by means of rubber rolls, dried with air blowing, and then immediately subjected to reflowing by means of resistance melting with current directly applied thereto.

EXAMPLE 3

A tin plate with #50 tin coating obtained in a similar way as in Example 1 is sprayed with an aqueous solution of 1% 3.5-di-methylpyrazole, uniformly squeezed by means of rubber rolls, dried with air blowing, and immediately subjected to reflowing by means of resistance melting with current directly applied thereto. Immediately after the reflowing, the tin plate is again sprayed with an aqueous solution containing 1% 3-methyl-5-hydroxypyrazole and 0.5% alumina sol, uniformly squeezed by means of rubber rolls and dried with air blowing.

EXAMPLE 4

A tin plate with #50 tin coating obtained in a similar way as in Example 1 is sprayed with an aqueous solution of 1% 3-methyl-5-hydroxypyrazole at 50° C uniformly squeezed by means of rubber rolls dried with air blowing immediately subjected to reflowing by means of resistance melting with current directly applied thereto, and, immediately after the reflowing, is sprayed with an aqueous solution containing 1% 3-methyl-5-hydroxypryazole and 0.5% alumina sol, and dried with hot air blast.

EXAMPLE 5

A tin plate with #50 tin coating obtained in a similar way as in Example 1 is sprayed with an aqueous solution of 1% 3.5-di-propyl-1-methoxycarbonylpyrazole at room temperature, uniformly squeezed by means of rubber rolls, dried with air blowing immediately subjected to reflowing by means of resistance melting with current directly applied thereto, immediately sprayed with an aqueous solution of 1% 3.5-di-propyl-1-methoxycarbonylpyrazole, uniformly squeezed by means of rubber rolls, and dried with hot air blowing.

The results of Examples 1 – 4 are set forth in Table 1, and the results of Example 5 is similar to the results of Examples 1 – 4.

COMPARATIVE EXAMPLE 1

A tin plate with #50 tin coating obtained in a similar way as in Example 1 is subjected to reflowing by means of resistance melting with direct current application, and then immediately subjected to cathodic treatment for 1 second at 4 A/dm$^2$ in a sodium bichromate solution (30 g/l, 40° C).

This comparative example represents the conventional chemical treatment.

COMPARATIVE EXAMPLE 2

A tin plate with #50 tin coating obtained in a similar way as in Example 1 is subjected by reflowing by means of resistance melting with direct current application.

Results of the above comparative examples are shown in Table 1.

Table 1

| | Paint Adhesion* | | | | | | | | |
|---|---|---|---|---|---|---|---|---|---|
| | Ericksen Test | DuPont Impact Test | Cap Fabrication Test | Cross Cut | Resistance** against Sulfide | Wetting Length of Solder (mm) | Eye-hole** property | Smudge**** property | Yellow Stain 210° C/ 30 min. |
| Example 1 | 10 | 10 | 10 | 10 | 10 | 20 | ◎ | 7 | ◎ |
| Example 2 | 10 | 10 | 10 | 10 | 10 | 20 | ◎ | 7 | ◎ |
| Example 3 | 10 | 10 | 10 | 10 | 10 | 21 | ◎ | 7 | ◎ |
| Example 4 | 10 | 10 | 10 | 10 | 10 | 20 | ◎ | 7 | ◎ |
| Comparative Example 1 | 9 | 9 | 8 | 5 | 10 | 21 | ◎ | 6 | ◎ |
| Example 2 | 9 | 10 | 8 | 8 | 0 | 17 | ◎ | 5 | X |

*Paint Adhesion (paint . . . SK-4451BS by Sakuranomiya Chemicals Co., Ltd.) . . . Coated Amount: 54.5mg/dm$^2$; Ericksen: 5mm; DuPont Impact Value: 40cm/l kg;

**Resistance against sulfide . . . Tests are done using salmon (washed with 10% NaCl aqueous solution) at 120° C for 1½ hours in a retort.

***Eye-hole property . . . Determined using oil varnish (7710-DL by Kansai Paints Co., Ltd.); Epoxy urea (Q-7822 by Dainippon Ink & Chemicals, Inc., and 14-479A by Toyo Ink Mfg. Co., Ltd.)

****Smudge property . . . Determined by the blacking as measured when the test piece is moved 450mm under a load of 1.8 kg/10cm.

Estimates: 10 represents "excellent", ○ represents "bad", ◎ represents "excellent" and X represents "bad".

What is claimed is:

1. A method for surface treating an electrolytic tin plate, comprising coating an electrolytically tin-plated steel sheet with an aqueous solution consisting essentially of 0.1 to 10% of a pyrazole derivative after the step of electrolytically tin-plating the steel sheet prior to the step of reflowing the plated tin layer on the steel sheet, and then subjecting the thus-treated tin plate to drying and reflowing.

2. A method according to claim 1 in which the pyrazole derivative has the following general formula

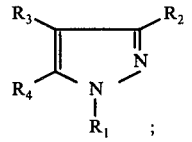

wherein $R_1$ represents H,—$CH_2OH$ or —$CH_2COOH$, $R_2$ and $R_4$ represent respectively an alkyl group of $C_1$ to $C_{10}$, -OH or -$CH_2OH$, and $R_3$ represents H or $NH_2$.

3. A method according to claim 2, wherein the aqueous solution also contains 0.1 to 10% of a colloidal substance selected from the group consisting of silica sol, and alumina sol.

4. A method according to claim 3, wherein the colloidal substance is silica sol.

5. A method according to claim 3, wherein the colloidal substance is alumina sol.

6. A method according to claim 1, in which the tin-plated steel sheet is again treated with the aqueous solution after the reflowing step.

7. A method according to claim 1, wherein the aqueous solution also contains a colloidal substance selected from the group consisting of silica sol, and alumina sol.

8. A method according to claim 7, wherein the aqueous solution consists essentially of 0.1 to 10% of the colloidal substance as well as 0.1 to 10% of the pyrazole derivative.

* * * * *